US006851478B2

(12) United States Patent
Cornelssen et al.

(10) Patent No.: US 6,851,478 B2
(45) Date of Patent: Feb. 8, 2005

(54) Y-BODY CHRISTMAS TREE FOR USE WITH COIL TUBING

(75) Inventors: Michael James Cornelssen, Edmonton (CA); Tony M. Lam, Edmonton (CA); Keith David Farquharson, Edmonton (CA)

(73) Assignee: Stream-Flo Industries, Ltd., Edmonton (CA)

( * ) Notice: Subject to any disclaimer, the term of this patent is extended or adjusted under 35 U.S.C. 154(b) by 0 days.

(21) Appl. No.: 10/360,532

(22) Filed: Feb. 7, 2003

(65) Prior Publication Data

US 2004/0154790 A1 Aug. 12, 2004

(51) Int. Cl.[7] ..... E21B 33/43
(52) U.S. Cl. ..... 166/368; 166/77.2; 166/95.1
(58) Field of Search ..... 166/368, 77.2, 166/90.1, 95.1, 97.1

(56) References Cited

U.S. PATENT DOCUMENTS

| | | | | |
|---|---|---|---|---|
| 3,139,932 A | * | 7/1964 | Johnson | 166/368 |
| 4,154,299 A | * | 5/1979 | Winders | 166/91.1 |
| 6,457,530 B1 | | 10/2002 | Lam et al. | 166/368 |

FOREIGN PATENT DOCUMENTS

| | | | |
|---|---|---|---|
| CA | 2268223 | 4/1999 | E21B/37/00 |
| CA | 2310236 | 12/2001 | E21B/37/00 |

OTHER PUBLICATIONS

Wellhead Control Products, *Capillary Equipment*product brochure Available online at <http://www.wellheadcontrol-.com/capillary.htm> (date accessed Mar. 31, 2003).

Select Energy Systems, *Capillary Tubing Hanger*product specification, Oct. 29, 2002.

* cited by examiner

*Primary Examiner*—William Neuder
(74) *Attorney, Agent, or Firm*—Greenlee, Winner and Sullivan, P.C.

(57) ABSTRACT

The invention provides a Y-body Christmas tree for use with coil tubing and other wellhead components which integrates components of a Christmas tree, while providing for coil tubing access without necessarily adding to the vertical height of the unit. The Y-body Christmas tree includes firstly, a body formed as a single piece of steel and forming a vertical bore extending axially therethrough, wherein the body comprises in sequence from the bottom to the top:

i) a bottom connector for connecting to a wellhead component located therebelow;

ii) a first valve housing section forming a side opening communicating with the vertical bore;

iii) a flow tee housing section forming at least one side opening communicating with the vertical bore, for producing well flow; and iv) a top connector for connecting to a wellhead component located thereabove. The Y-body Christmas tree also includes a first shut off valve located in the first valve housing for controlling well flow through the vertical bore, a coil tubing bore formed in the body which intersects and connects to the vertical bore below the first valve, and which extends upwardly at an angle from the vertical bore sufficient to feed coil tubing; and a coil tubing head assembly communicating with the coil tubing bore for inserting, sealing and suspending the coil tubing therein.

12 Claims, 7 Drawing Sheets

Y-BODY CHRISTMAS TREE FOR USE WITH COIL TUBING

FIELD OF THE INVENTION

The invention relates to a Y-Body Christmas Tree for use in wellheads to provide access for coil tubing.

BACKGROUND OF THE INVENTION

Conventional wellhead equipment used in connection with completed oil and gas production wells include, from the bottom up, a flanged casing head having an internal casing hanger from which the casing is suspended; a flanged tubing head having an internal tubing hanger from which the well tubing string is suspended; and a "Christmas tree" consisting of multiple components, the interconnected components forming a vertical fluid flow bore which extends through the components from top to bottom. The overall wellhead assembly extending upwards from the top of the tubing head is commonly referred to as the production Christmas tree. Individual components of the Christmas tree are typically flange connected and sealed to each other top and bottom and include, upwards from the tubing head, a tubing head adapter; at least one, and commonly two, master valves (termed upper and lower master valves); a flow tee or studded cross member having side and top openings, typically studded for connecting with flow lines, one or more wing valves and additional components; a swab valve; and a cap at the upper end.

It is common in the oilfield industry to insert a string of coil tubing (also termed coiled tubing) into a completed oil or gas wellbore. The coil tubing may be used for a number of purposes such as chemical injection, servicing, or for carrying downhole sensors. The coil tubing is a continuous reeled pipe, generally of relatively small diameter, such as ¼ or ⅜ inch.

The coil tubing string is run into and out of the wellbore using coil tubing string injectors, which force the coil tubing string into the well. The coil tubing string is supported through a device known as a coil tubing hanger. The process is reversed as the coil tubing string is removed from the well.

There are generally three methods for running coil tubing into the wellbore. The first involves removing the Christmas tree cap at the top of the wellhead and then installing the coil tubing through the Christmas tree, such that it is concentric through the entire vertical section of the Christmas tree. Several problems can arise with this approach. To shut off the well in case of an emergency, the shut off valve may become inoperative because of interference with the coil tubing. The coil tubing may have to be severed by the shut off valve in order to control the well, and by doing this, the valves may be damaged. In either case, the shut off valves can become problematic or inoperative, and well control is given up. A second approach is to strap the coil tubing outside the tubing string, using an injection nipple to connect the two lines with check valves. This is a time-consuming approach to run in and install the coil tubing parallel to, and at the same time as, the tubing string. On completed wells, a rig must pull out the production tubing and reinstall with the production and coil tubing strapped together. A third technique includes adding a spool, generally in a Y-body shape, into the Christmas tree, and running the coil tubing through the Y or angled side arm into the vertical production bore. Generally this spool is connected between the two conventional valves in the Christmas tree, namely an upper master valve and a lower master valve. These valves are typically placed above the tubing head and tubing head adapter in the conventional Christmas tree of a wellhead. An example of this type of spool device is an RH-Y Capillary Spool available from Wellhead Control Products, Inc., Texas, U.S.A. This spool adds height to the wellhead, requires relocation of flowlines for existing wells, and creates significant safety issues as it becomes more difficult to work on the wellhead.

SUMMARY OF THE INVENTION

There is a need for a wellhead tool which provides convenient access for injecting coil tubing into a tubing string without necessarily adding height to the wellhead. The Y-body Christmas tree of the present invention does so, in a preferred embodiment by combining in an integral body, or forming as a composite tool, the Y-body coil tubing bore access, the upper master valve and the flow tee or studded cross member. By "integral" is meant that the body portion of the tree is formed from a single cast or forged steel body or structure which is machined to form the vertical fluid flow bore and other components noted as being integral. With respect to connectors noted as being integral, this terminology indicates that the body terminates with a body portion that is sized and adapted to connect to a named next component. Depending on the particular design of the connection, the components of the connectors that actually make the connection are not necessarily integral with the body. For instance, in the studded connections shown in the Figures, for connecting to flange components, the threaded studs, nuts and seals are separate from the body. By "vertical bore" is meant an axial bore which is vertical when installed.

The Y-body Christmas tree allows for passage and control of "well flow" (i.e., any combinations of pressurized fluids, solids and gases) through its vertical bore. Included is a coil tubing bore which intersects and connects to the vertical bore for coil tubing insertion and access to the well bore.

The Y-body Christmas tree includes and provides the following four components or elements:

1) Vertical Fluid Flow Bore

The vertical fluid flow bore is the main vertical bore, formed with one or more intersecting side outlets or openings. The vertical bore in the Y-body Christmas tree allows for passage and containment of the well flow. The vertical bore, along with its side outlets, has pressure connections at all inlets and outlets. These connections can be bolted, flanged, threaded or clamped, as is generally known in the industry.

2) Flow Control

The Y-body Christmas tree controls the passage and pressure of well flow. This is generally achieved with at least one shut-off valve and provides a means to shut-off the well flow in the vertical bore. Containing well flow below the shut off valve prevents it from accessing the flow bore outlets. This valve essentially shuts off the well.

Industry nomenclature refers to a shut-off valve as a "master" valve. Generally there are one or two master valves in a standard prior art Christmas tree assembly. The Y-body Christmas tree of this invention includes a minimum of one shut off valve, (i.e., the upper master valve). The Y-body Christmas tree may also include one or more of an integral lower master valve, swab valve, and wing valve. The valves referred to herein may be of any conventional shut off design, as well known in the industry, including for example gate valves, ball valves, and plug valves.

3) Coil Tubing Bore

A coil tubing bore is formed in the body itself, and may also be included as an extension in a side arm of the body, to provide an independent angular bore that intersects the vertical flow bore. The angular coil tubing bore intersects and connects with the vertical bore below the upper master valve. The angular bore allows for inserting, installing or injecting the coil tubing within the vertical bore. The angular bore may be formed in an integral side arm with the Y-body assembly, or can be formed in a side arm attached using pressure connections. These connections can be bolted, flanged, threaded, clamped or welded.

4) Coil Tubing Suspension

The side arm of the Y-body Christmas tree provides for a coil tubing head assembly as a means for inserting, suspending and sealing the coil tubing within the coil tubing bore. The coil tubing head assembly preferably also includes a valve means to prevent against back pressure from the wellbore. The tubing head assembly is thus a combination of pressure containing or controlling parts. The components of the tubing head assembly may be varied from the preferred embodiment of the Figures to include sealing threads, slips, seals, check valves, lockscrews, bolting, ring gaskets and test ports. The tubing head assembly may be formed integral with the Y-body or side arm, or may be attached using pressure connections. These connections can be bolted, flanged, threaded, clamped or welded.

Broadly stated, the invention provides a Y-body Christmas tree for use with coil tubing and other wellhead components which integrates components of a Christmas tree, while providing for coil tubing access. This is accomplished without necessarily changing the position of the connection to an available flow line (if existing) compared to a convention Christmas tree with similar components provided separately. The Y-body Christmas tree includes firstly, a body formed as a single piece of steel and forming a vertical bore extending axially therethrough, wherein the body includes in sequence from the bottom to the top:

i) a bottom connector for connecting to a wellhead component located therebelow;

ii) a first valve housing section forming a side opening communicating with the vertical bore;

iii) a flow tee housing section forming at least one side opening communicating with the vertical bore, for producing well flow; and iv) a top connector for connecting to a wellhead component located thereabove.

The Y-body Christmas tree also includes a first (upper) shut off valve means located in the first valve housing for controlling well flow through the vertical bore, a coil tubing bore formed in the body which intersects and connects to the vertical bore below the first valve means, and which extends upwardly at an angle from the vertical bore sufficient to feed coil tubing; and a coil tubing head assembly communicating with the coil tubing bore for inserting, sealing and suspending the coil tubing therein.

In a preferred embodiment, a side arm between the body and the coil tubing head is included, with the side arm forming an extension of the coil tubing bore which communicates with the coil tubing head assembly. Preferably, the bottom connector is adapted to connect to a tubing head adapter, a tubing head, or a lower master valve located therebelow.

In a second embodiment of the invention, the body further includes a second (lower) valve housing section formed below and integral with the first valve housing, the second valve housing section forming a side opening communicating with the vertical bore. The tree further includes a second (lower) shut off valve means located in the second valve housing for controlling well flow through the vertical bore, and the coil tubing bore intersects and connects to the vertical bore between the first and second valve means. In this second embodiment, the bottom connector is adapted to connect to a tubing head adapter located therebelow.

In a third embodiment of the invention, the body further includes a tubing head adapter housing section below, and preferably integral with, the second valve housing section, and the bottom connection is adapted to connect to a tubing head located therebelow.

The top and bottom connectors may be adapted for bolted, flanged or clamped connections, as desired to connect to adjacent wellhead tools.

In another broad aspect of this invention, the coil tubing head assembly may be formed with a bottom flange, and used above a conventional Christmas tree to insert, suspend and seal the coil tubing within the coil tubing assembly.

DESCRIPTION OF THE PREFERRED EMBODIMENTS

Figure 1:
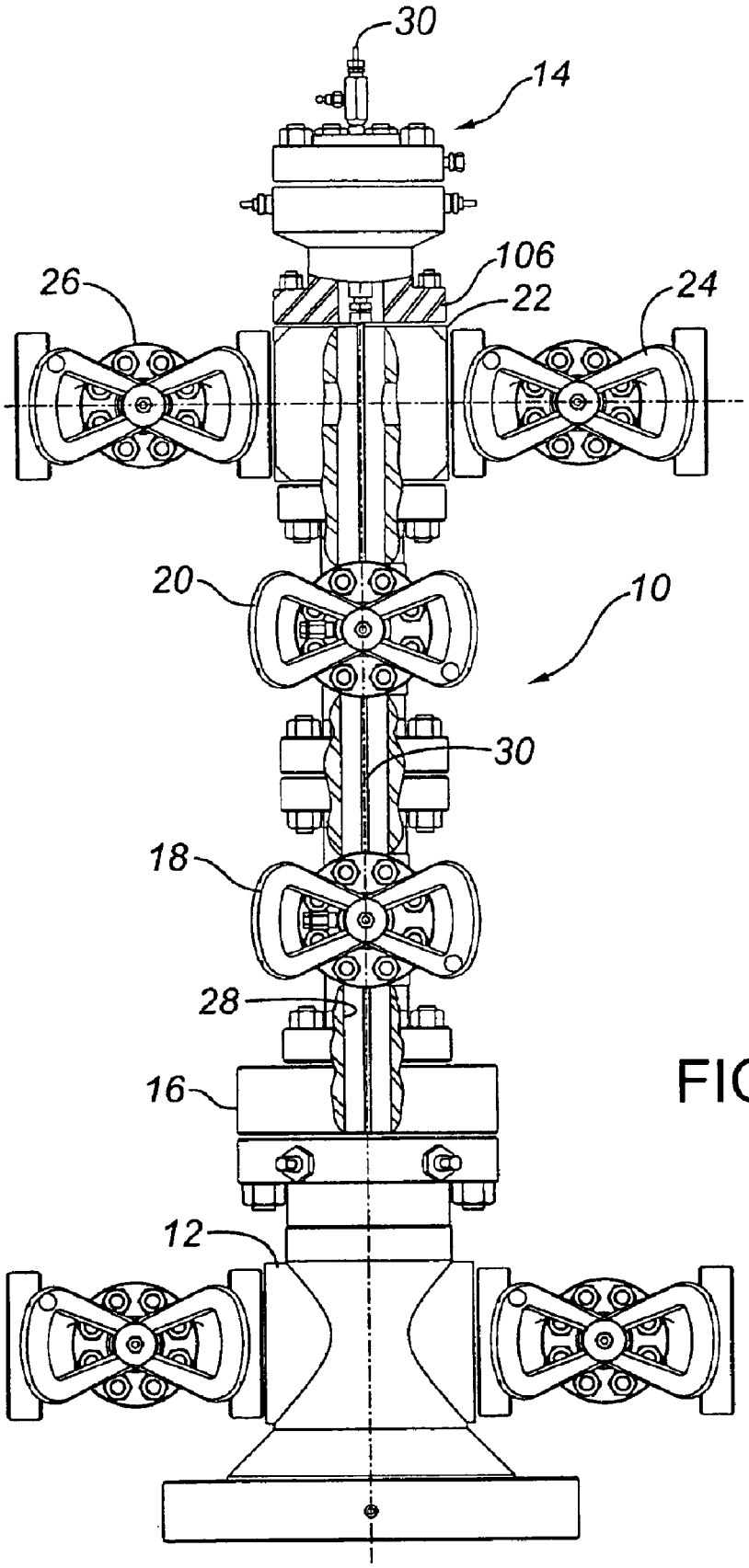
FIG. 1 is a side view, partially in section, of a conventional, prior art Christmas tree wellhead above a tubing head. The Christmas tree is shown to include at its upper end, the coil tubing head assembly of the present invention. The components of the conventional prior art Christmas tree are shown, in sequence from the bottom, a tubing head adapter (attached to the lower tubing head), a lower master gate valve, an upper master gate valve, and a flow tee (or studded cross) with diametrically opposed side access to a flow line gate valve and a kill line gate valve.
Figure 4:
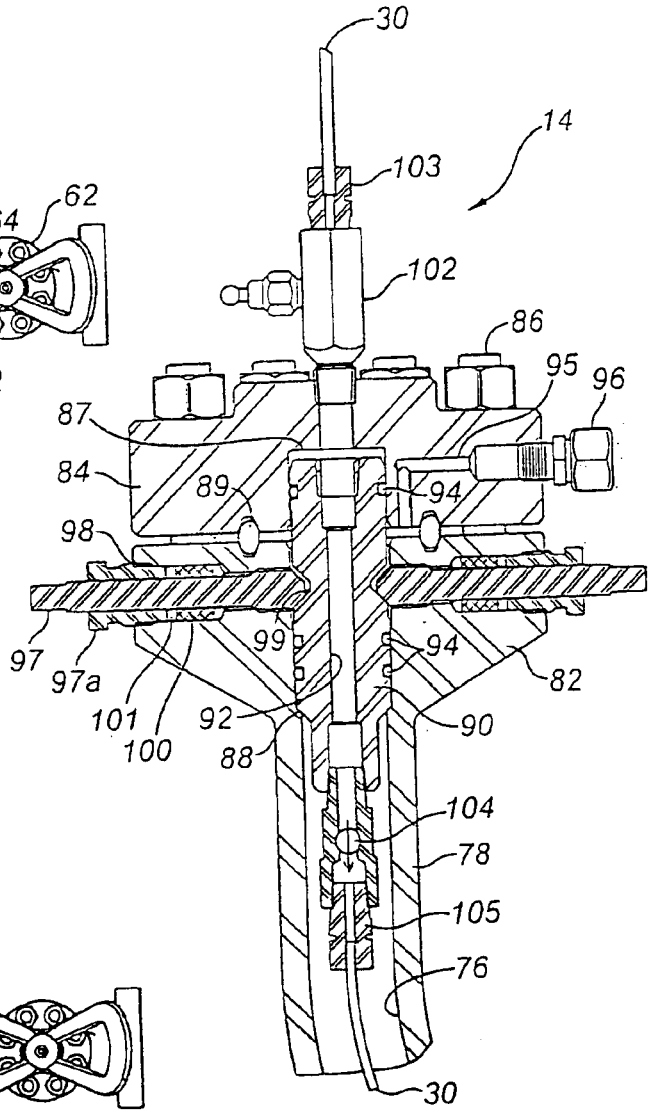
FIG. 4 is a side sectional view of the coil tubing head assembly portion of the Y-body Christmas tree shown as circle 4 in FIG. 3.
Figure 5:
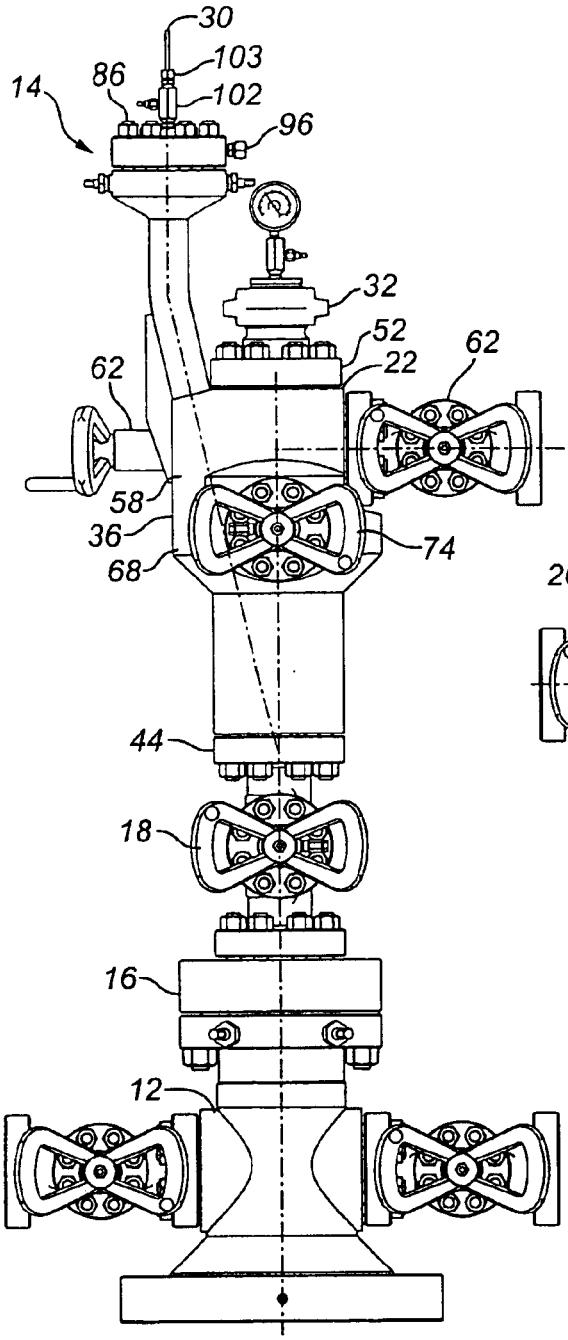
FIG. 5 and FIG. 6 are side views of, respectively, the Y-body Christmas tree of FIG. 3, and the prior art conventional Christmas tree wellhead of FIG. 1 (without the coil tubing assembly), demonstrating that the Y-body Christmas tree of the present invention which includes integral flow tee, upper master gate valve and coil tubing bore for coil tubing access, adds no additional height to the conventional Christmas tree wellhead which includes a flow tee, upper and lower master gate valves and a flow tee as separate components.
Figure 6:
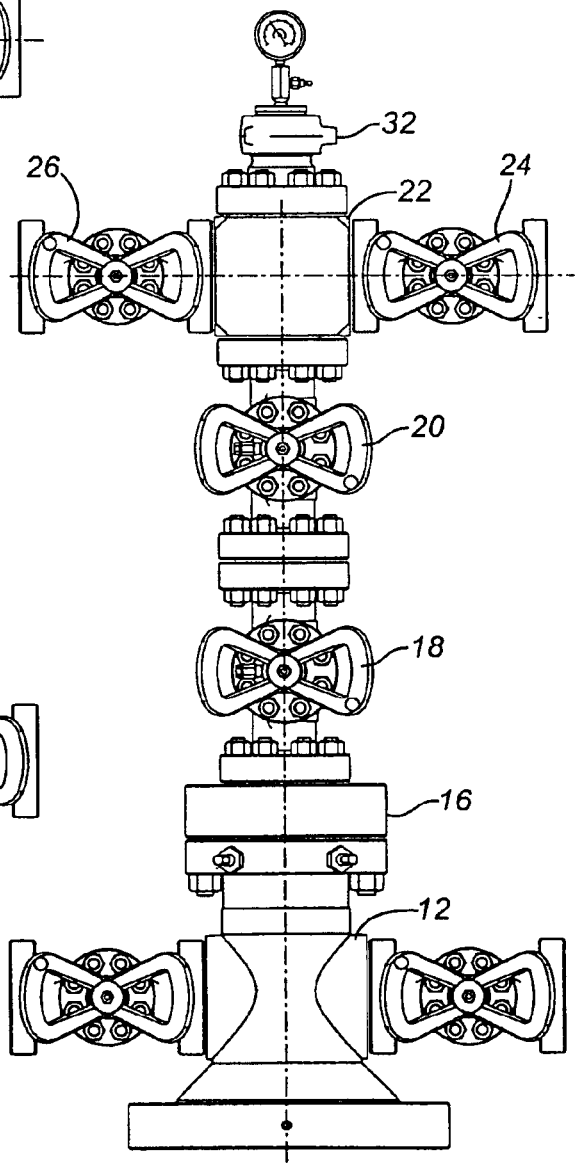
FIG. 6 (Prior Art)

The Y-body Christmas tree of this invention is shown in FIGS. 2–5 and 7–10, while a comparable conventional prior art Christmas tree for a completed well is shown in FIGS. 1 and 6. In FIG. 1, the separate components of a conventional Christmas tree, shown generally at 10, are located between a conventional tubing head 12 and the coil tubing assembly 14 of the present invention. In FIG. 6, all components shown are as found in a conventional prior art Christmas tree. The conventional Christmas tree 10 includes sequentially, from the bottom to the top as separate, generally tubular flanged components, a tubing head adapter 16, a lower master gate valve 18, an upper master gate valve 20, and a flow tee 22. The flow tee 22 is shown to provide side access for well flow to diametrically opposed flow line gate valve 24 and kill line gate valve 26. As shown in FIG. 1, these components of the Christmas tree 10 are formed as separate components, which when connected together, provide a vertical fluid flow bore 28 extending therethrough for well flow. With the conventional Christmas tree 10, coil tubing 30 is injected and suspended by removing the upper cap 32 (see FIG. 6) at the top of the Christmas tree 10, and installing the coil tubing assembly 14. The coil tubing assembly 14 provides a means for inserting, sealing and suspending the coil tubing 30 in the vertical bore 28.

Figure 2:
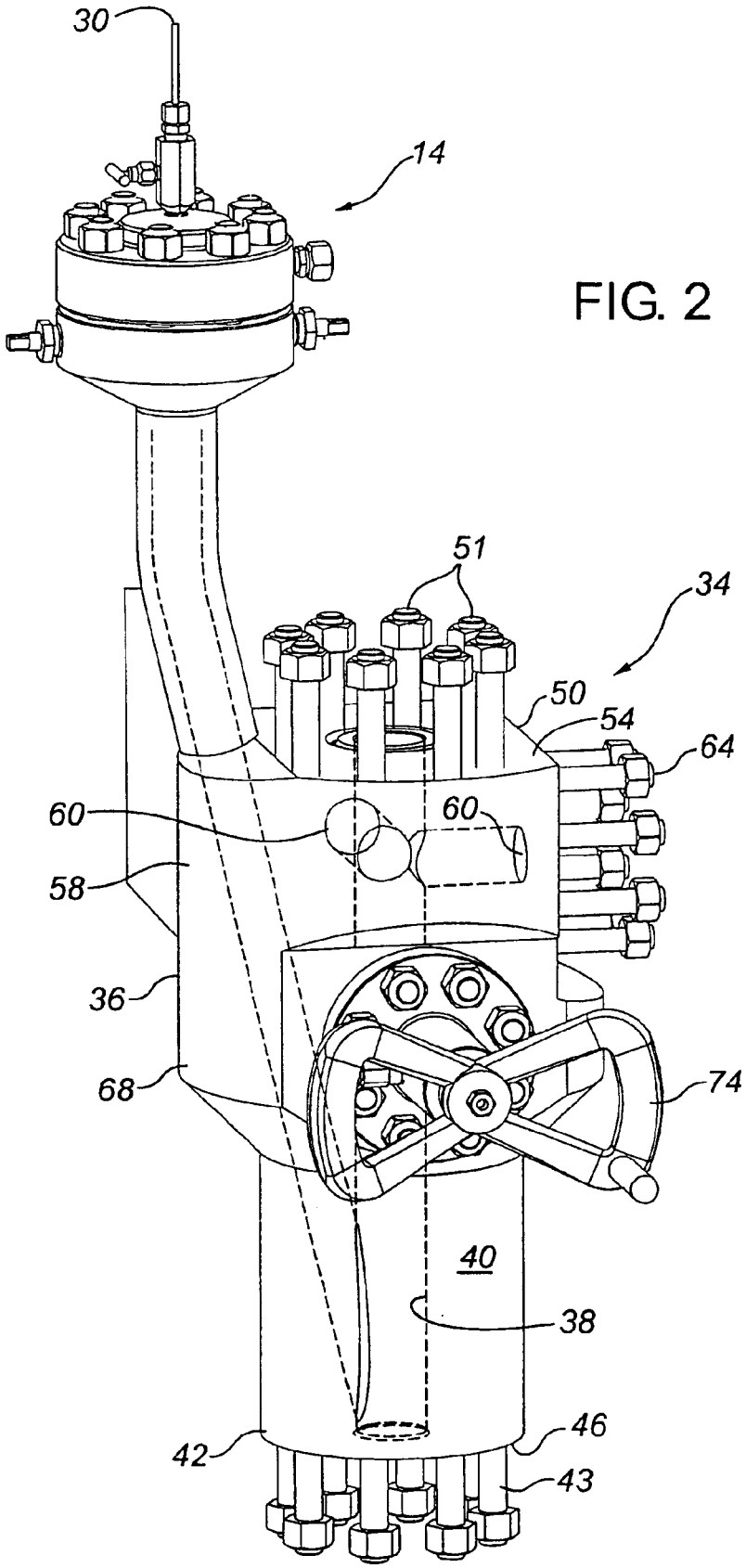
FIG. 2 is a side view of the Y-body Christmas tree of the present invention showing top, bottom and side connections for other conventional wellhead components.
Figure 3:
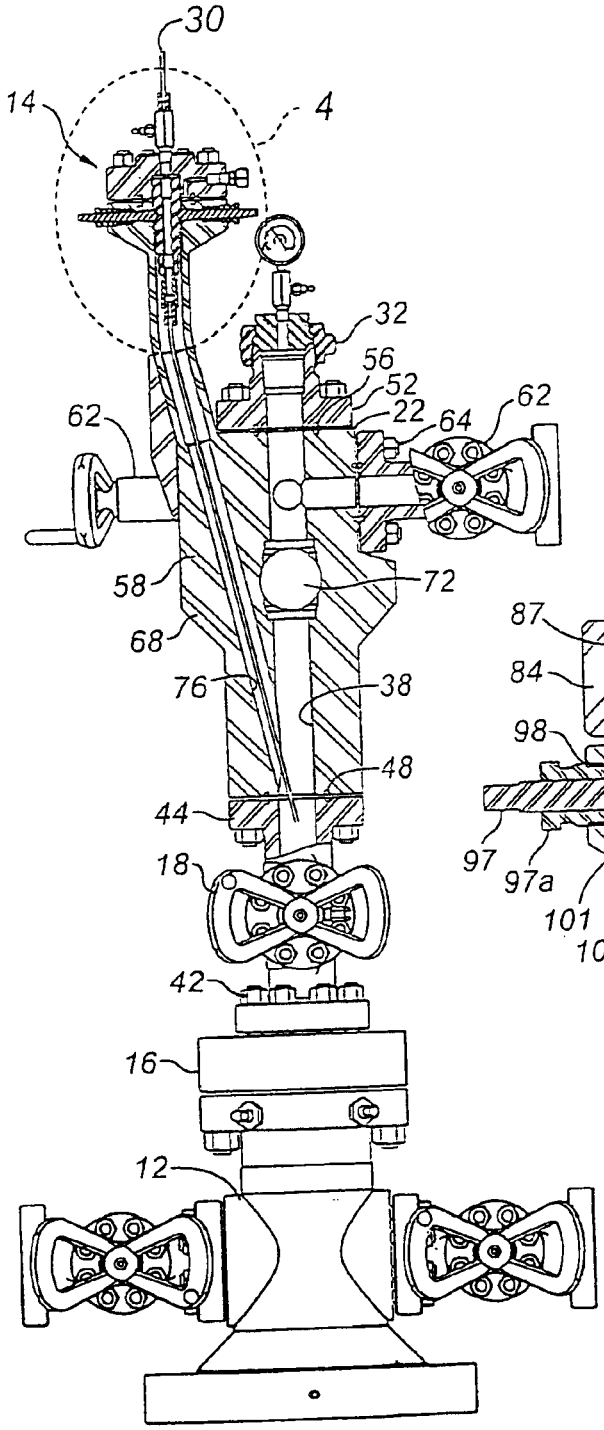
FIG. 3 is a side view, partially in section, of the Y-body Christmas tree of the present invention, mounted above the lower master gate valve component of a conventional Christmas tree wellhead.

Turning to the present invention, where conventional Christmas tree components are shown in the Figures, the above like numerals will be used. FIG. 2 shows the Y-body Christmas tree generally at 34 to include an integral body 36 formed as a single piece of steel. The body 36 forms an axial, vertical fluid flow bore 38 which is generally cylindrical and extends therethrough. The body 36 is formed with a side wall 40 of sufficient thickness to withstand typical wellbore pressures, as is known in the art.

The body 36 has a bottom connector 42 for connection to a wellhead component (not shown in FIG. 2) located therebelow. In the embodiment of FIGS. 2–5, the bottom connector 42 is shown to provide for a studded down connection (i.e., accommodates multiple threaded studs and nuts 43) for connection with a flanged top connection 44 of the conventional lower master gate valve 18. However, the bottom connector 42 may vary, for example as a threaded connection or a clamp-hub connection, depending on the design of the lower wellhead component. While not shown in the Figures, the face 46 of the bottom connector 42 forms a seal ring groove (not shown) extending around the vertical bore 38 to accommodate a seal ring 48 (see FIG. 3) which forms a fluid tight seal when the bottom connector 42 is tightened against the lower master valve flange connection 44. As is known in the art, fluid tight seals are provided for between all connections of separate components in the wellhead, and the terms "connecting", "connections" or "connectors" as used herein and in the claims is meant to include provision for such seals, without implying that the seals are integral with the body 36.

The body 36 provides a top connector 50 for connecting to the wellhead component (not shown in FIG. 2) located thereabove. In the embodiment of FIGS. 2–5, the top connector 50 is shown to provide for a studded up connection (i.e., accommodates multiple threaded studs and nuts 51) for connection with the flanged bottom connection 52 of a conventional upper cap 32 of a Christmas tree. However, as for the bottom connector 42, the top connector 50 may vary in design as is known in the art, for connection with upper wellhead components. While not shown in the Figures, the face 54 of the top connector 50 is formed with a seal ring groove (not shown) extending around the vertical bore 38 to accommodate a seal ring 56 (see FIG. 3) which forms a fluid tight seal when the top connector 50 is tightened against the flanged bottom connection 52 of the upper cap 32.

Figure 7:
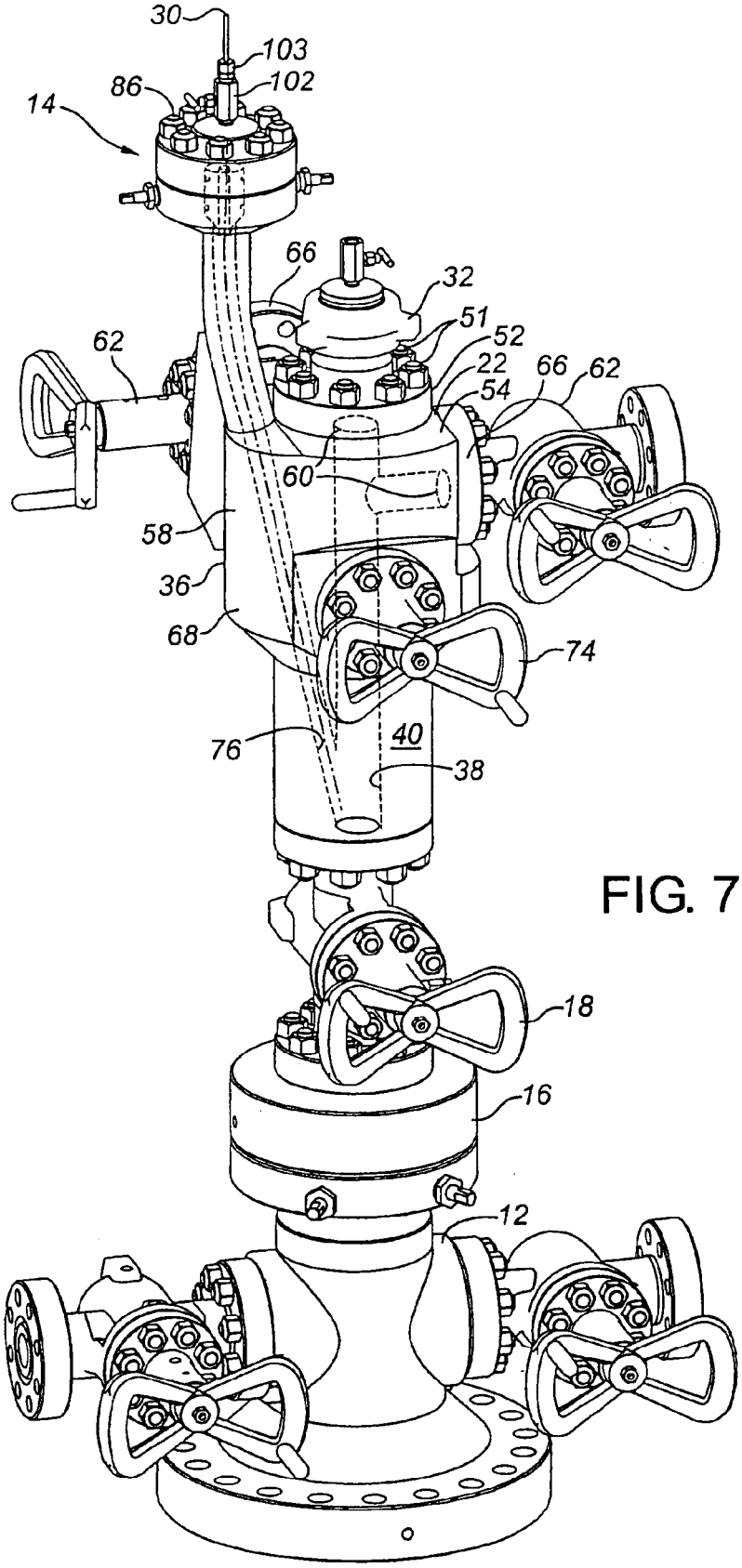
FIG. 7 is a perspective view of the Y-body Christmas tree of FIG. 3, rotated 90° to show additional detail, and showing interior bores in dotted outline.
Figure 8:
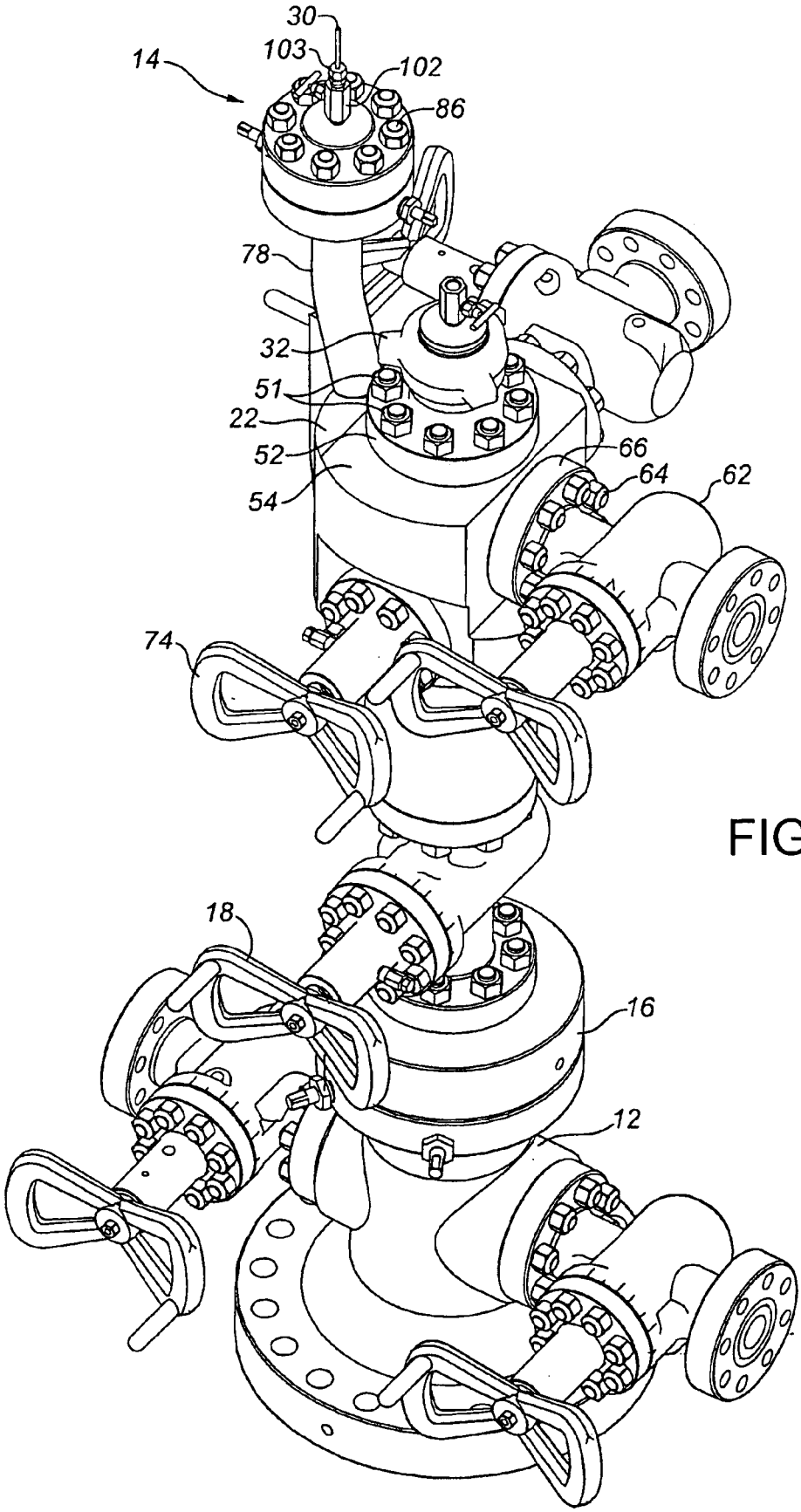
FIG. 8 is a further perspective view of the Y-body Christmas tree of FIG. 5, further rotated relative to FIG. 7, to show additional detail.

Below the top connector 50, the body 36 forms a flow tee housing section 58 which is integral with the top connector 50. The flow tee housing section 58 forms at least one, and preferably two side openings 60 communicating with the vertical bore 38 for connecting to flow lines (not shown) or to valves 62 (see FIGS. 7 and 8), for producing well flow. As best seen in FIGS. 7 and 8, these side openings are preferably formed at 90° to one another, to allow for access for the valves 62. The valves 62 shown in the Figures are flow line gate valves and kill line gate valves, well known in the art. Adjacent the side openings 60, the flow tee housing 58 forms studded side connectors 64 for connection with the flanges 66 of the valves 62.

Below the flow tee housing section 58, and integral therewith, is a first valve housing section 68. This first valve housing section 68 forms a first valve chamber (not shown) communicating with the vertical bore 38, and which opens out the side of the body 36. The first valve chamber accommodates a first gate valve 72 (conventional in the industry) which is operative as a shut off valve to open or close the vertical bore 38. The first gate valve 72 is operated by a hand wheel and bonnet assembly 74 shown in the Figures to be flange connected and protruding external to the body 36.

As is evident from the Figures, the valve components and controls for the gate valve 72 and the flow tee valves 62 are offset from each other, and staggered around the periphery of the body 36. This is done to best accommodate independent operation of these components, and to allow for connection to these components in accordance with industry standards.

The body 36 forms a coil tubing bore 76 which intersects and connects to the vertical bore 38 below the first valve housing section (i.e., below the first gate valve 72). The coil tubing bore 76 extends upwardly at an angle from the vertical bore 38 (generally at an angle to the vertical bore 38 so as to form a Y with the vertical bore), the angle and length of the bore 76 being sufficient to allow the coil tubing 30 to be fed through the coil tubing bore 76 and into the vertical bore 38. A generally tubular side arm 78 is preferably connected to the body 36 to provide an extension of the coil tubing bore 76, as may be required for the appropriate angle and length to accommodate the coil tubing 30. Alternatively, the body 36 may be extended to form this extension of the coil tubing bore 76 integral in the body.

A coil tubing head assembly 14 is formed at the top of the side arm 78 for inserting, suspending and sealing the coil tubing 30 within the coil tubing bore 76. The detail of the coil tubing assembly 14 is best seen in FIG. 4. The head assembly 14 includes a widened coil tubing head 82, integral with the side arm 78, and a coil tubing head adapter 84 connected thereabove with bolted connectors 86. The coil tubing bore 76 extends through the tubing head 82 and adapter 84, narrowing at an upper stop shoulder 87 formed in the adapter 84 and at a lower landing shoulder 88 formed in the tubing head 82. A metal seal ring gasket 89 is provided around the coil tubing bore 76 between the head 82 and the adapter 84 so as to form a fluid tight seal therebetween on tightening of the bolted connectors 86.

A coil tubing hanger 90 formed with a central bore 92 sized to accommodate connection to the coil tubing 30 is provided in sealing relationship in the coil tubing bore 76 between the head 82 and the adapter 84. The central bore 92 is threaded top and bottom. O-ring seals 94 on the tubing hanger 90 provide seals to the bore 76 in both the head 82 and the adapter 84. A threaded test port 95 is preferably formed in the tubing head adapter 84 to allow for testing of the seals 89 and 94 with a test connection (not shown). Shown closing the outlet of the port 95 is a threaded sealing screw 96 which forms a threaded seal with the port 95.

The coil tubing hanger 90, once landed in the tubing assembly 14, and secured with the bolted down tubing head adapter 84, is thus sealed in the coil tubing bore 76 between upper stop shoulder 87 and lower landing shoulder 88. The tubing hanger 90 is further secured with a plurality of tubing hanger hold down screws 97 which extend through side openings 98 in the tubing head 82 to a circumferential groove 99 formed in the tubing hanger 90. Each hold down screw 97 is threaded into the openings 98 and provides a pressure seal through the components of a gland nut 97*a*, packing 100 and washers 101.

The coil tubing 30 is installed into the top of the coil tubing bore 76 through a threaded needle valve 102 and a threaded top coil tubing connector 103 (which protrude from the tubing head adapter 84), so as to seal the coil tubing 30 at the top end of the bore 76. The needle valve 102 allows one to isolate the pressure at the top of the tubing head assembly, should this be needed. The coil tubing 30 is sealed to and connected at the lower end of the tubing hanger 90 with a threaded check valve 104 and a threaded bottom coil tubing connector 105. The check valve 104 may be a one way ball check valve, as shown schematically in FIG. 4, to prevent against back pressure from the wellbore, although other valve means for this purpose may be employed. Alternatively, the check valve 104 may be formed as an integral part of the tubing hanger 90. Other designs of a coil tubing head assembly may be used, as are known in the art.

As shown in FIG. 1, the coil tubing assembly 14 may be formed as a separate component with a bottom connector such as a bottom flange 106. In the embodiment shown in FIG. 1, the coil tubing assembly may be used to insert, suspend and seal the coil tubing 30, by connecting above the flow tee 22 of a conventional Christmas tree 10.

As shown in side by side FIGS. 5 and 6, the Y-body Christmas tree 34 of the present invention, which includes the functions and components for a flow tee, upper master valve and coil tubing access, has a vertical height which does not substantially change the vertical position of the side openings 60 in the flow tee housing section 58, compared to that in a compared to a conventional Christmas tree (see FIG. 6) which includes a flow tee 22 and an upper master valve 20 as separate components (height being the same, or no greater, as measured between the top connector 50 of the flow tee component and the bottom connector 42 to the lower master gate valve 18 in each of FIGS. 5 and 6). This allows for connection of the Y-body Christmas tree 34 to other conventional wellhead components or equipment while maintaining industry standards. The invention also considerably decreases downtime for the installation of coil tubing in a completed wellhead.

Figure 9:
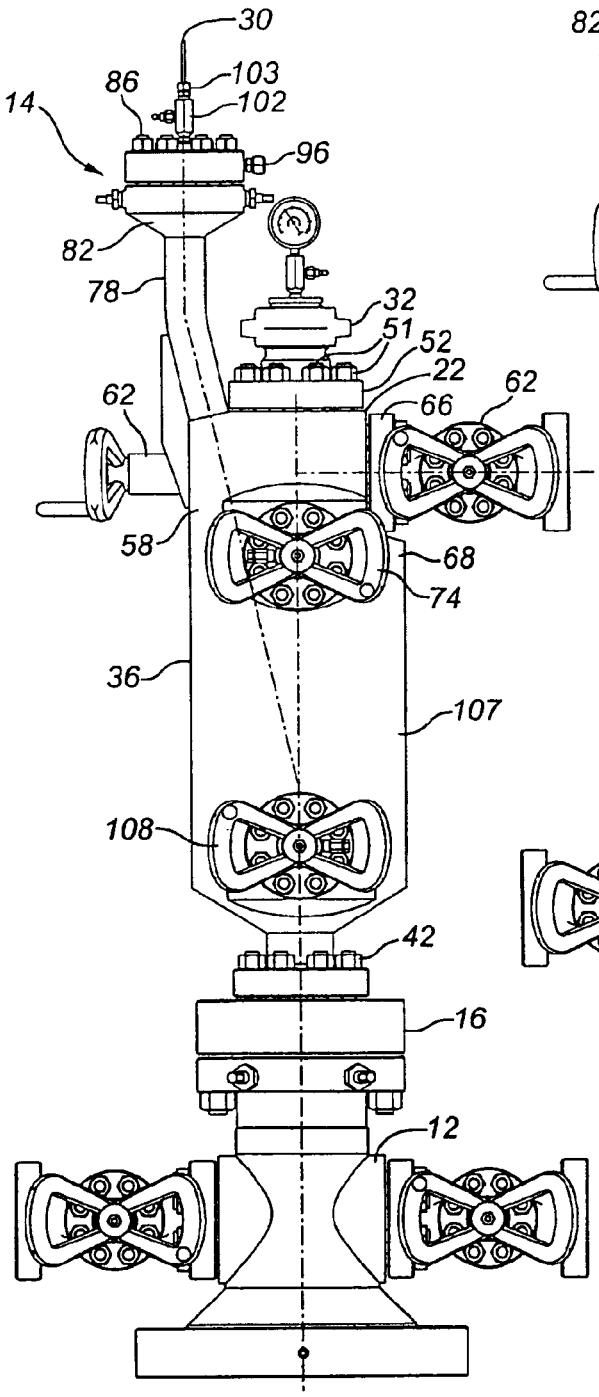
FIG. 9 is a side view of a second embodiment of the Y-body Christmas tree of this invention, with an integral lower master gate valve, and showing the axis of the vertical and coil tubing bores in dotted outline.
Figure 10:
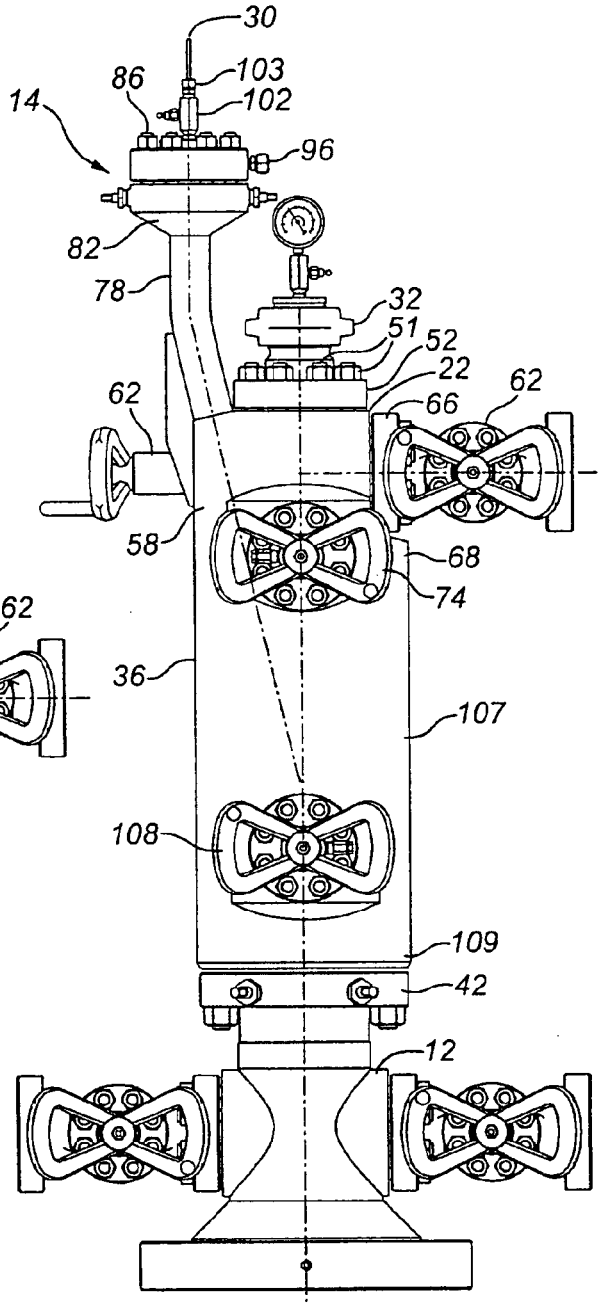
FIG. 10 is a side view of a third embodiment of the Y-body Christmas tree of this invention, with an integral lower master gate valve and a lower tubing head adapter, and showing the axis of the vertical and coil tubing bores in dotted outline.

In alternate embodiments, the Y-body Christmas tree of this invention may include one or both of the features of a lower master gate valve and a tubing head adapter, as shown respectively in FIGS. 9 and 10. As shown in FIG. 9, the body 36 is extended to include a second valve housing section 107, integral with the first valve housing 68. Inclusion of lower master gate valve components extends the vertical bore 38. The coil tubing bore 76 intersects and connects to the vertical bore 38, as shown in dotted lines in FIG. 9, at a point between the first gate valve 72 and a second gate valve 108 (in FIG. 9, the second gate valve is illustrated only by its hand wheel and bonnet assembly) Other aspects of the second valve housing section 107 and the second gate valve 108 are generally the same as for the first valve housing section 68 and first gate means 72, so are not shown in the Figures. In FIG. 9, the bottom connector 42 is adapted to connect to the tubing head adapter 16 through flanges and studded down connections.

In FIG. 10, the body 36 is shown to include an integral tubing head adapter section 109, such that the bottom connector 42 is shown adapted to connect directly to the tubing head 12, again through flanges and studded down connections.

The embodiments shown in FIGS. 9 and 10, as with the embodiment in the other Figures, can be formed without necessarily adding any height to that which the tree would have if formed from separate components. In fact, as extra flange connections are avoided (ex. FIG. 10 avoids extra flange connections of tubing head adapter), the Y-body Christmas tree of this invention may be designed to reduce the overall height of the tree, if desired.

All publications mentioned in this specification are indicative of the level of skill in the art of this invention. All publications are herein incorporated by reference to the same extent as if each publication was specifically and individually indicated to be incorporated by reference. The terms and expressions used are, unless otherwise defined herein, used as terms of description and not limitation. There is no intention, in using such terms and expressions, of excluding equivalents of the features illustrated and described, it being recognized that the scope of the invention is defined and limited only by the claims which follow.

We claim:

1. A Y-body Christmas tree for use with coil tubing and other wellhead components, comprising:

a) a body formed as a single piece of steel and forming a vertical bore extending axially therethrough, said body comprising in sequence from the bottom to the top:

i) a bottom connector for connecting to a wellhead component located therebelow;

ii) a first valve housing section forming a side opening communicating with the vertical bore;

iii) a flow tee housing section forming at least one side opening communicating with the vertical bore, for producing well flow; and iv) a top connector for connecting to a wellhead component located thereabove; and said Y-body Christmas tree further comprising:

b) first shut off valve located in the first valve housing for controlling well flow through the vertical bore;

c) a coil tubing bore formed in the body which intersects and connects to the vertical bore below the first valve, and which extends upwardly at an angle from the vertical bore sufficient to feed coil tubing; and d) a coil tubing head assembly communicating with the coil tubing bore for inserting, sealing and suspending the coil tubing therein.

2. The Y-body Christmas tree of claim 1, further comprising a side arm between the body and the coil tubing head, said side arm forming an extension of the coil tubing bore which communicates with the coil tubing head assembly.

3. The Y-body Christmas tree of claim 2, wherein the bottom connector is adapted to connect to a tubing head adapter, a tubing head, or a lower master valve located therebelow.

4. The Y-body Christmas tree of claim 2, wherein the body comprises a second valve housing section formed below and integral with the first valve housing, said second valve housing section forming a side opening communicating with the vertical bore, wherein the tree further comprises a second shut off valve located in the second valve housing for controlling well flow through the vertical bore, and wherein the coil tubing bore intersects and connects to the vertical bore between the first and second valves.

5. The Y-body Christmas tree of claim 4, wherein the bottom connector is adapted to connect to a tubing head adapter located therebelow.

6. The Y-body Christmas tree of claim 2, wherein the body comprises a tubing head adaptor housing section integral with the second valve housing section and wherein the bottom connection is adapted to connect to a tubing head located therebelow.

7. The Y-body Christmas tree of claim 4, wherein the body comprises a tubing head adaptor housing section integral with the second valve housing section and wherein the bottom connection is adapted to connect to a tubing head located therebelow.

8. The Y-body Christmas tree of claim 2, wherein the coil tubing head assembly includes a tubing hanger for suspending the coil tubing, and for sealing within the coil tubing bore.

9. The Y-body Christmas tree of claim 7, wherein the coil tubing head assembly includes a tubing hanger for suspending the coil tubing, and for sealing against the coil tubing within the coil tubing bore.

10. The Y-body Christmas tree of claim 1, wherein the Y-body Christmas tree has a vertical height as measured between the top and bottom connectors which does not substantially change the vertical position of the side openings in the flow tee housing section compared to that in a Christmas tree having equivalent flow tee and upper master valve formed as separate components.

11. The Y-body Christmas tree of claim 4, wherein the Y-body Christmas tree has a vertical height as measured between the top and bottom connectors which does not substantially change the vertical position of the side openings in the flow tee housing section compared to that in a Christmas tree having equivalent flow tee and upper and lower master valves formed as separate components.

12. The Y-body Christmas tree of claim 7, the Y-body Christmas tree has a vertical height as measured between the top and bottom connectors which does not substantially change the vertical position of the side openings in the flow tee housing section compared to that in a Christmas tree having an equivalent flow tee, upper and lower master valves and tubing head adapter formed as separate components.

* * * * *